US007690886B2

(12) United States Patent
Sakai et al.

(10) Patent No.: US 7,690,886 B2
(45) Date of Patent: Apr. 6, 2010

(54) PUMP AND LIQUID SUPPLY APPARATUS HAVING THE PUMP

(75) Inventors: Toshisuke Sakai, Onojo (JP); Motohiko Matsuguma, Tosu (JP); Tetsuya Fukuda, Munakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 402 days.

(21) Appl. No.: 11/461,101

(22) Filed: Jul. 31, 2006

(65) Prior Publication Data

US 2007/0048148 A1 Mar. 1, 2007

(30) Foreign Application Priority Data

Aug. 25, 2005 (JP) ..... 2005-244914

(51) Int. Cl.
*F04D 29/40* (2006.01)

(52) U.S. Cl. ..... 415/56.5; 415/58.4; 415/226; 415/224

(58) Field of Classification Search ..... 415/58.4, 415/56.5, 226; 417/324
See application file for complete search history.

(56) References Cited

U.S. PATENT DOCUMENTS

| | | | | |
|---|---|---|---|---|
| 3,270,678 | A * | 9/1966 | La Monica | 415/206 |
| 3,276,385 | A * | 10/1966 | Marlow | 415/147 |
| 3,741,679 | A * | 6/1973 | Johnston | 415/172.1 |
| 3,779,667 | A * | 12/1973 | Johnson | 415/172.1 |

FOREIGN PATENT DOCUMENTS

| | | |
|---|---|---|
| JP | 39-20478 | 7/1964 |
| JP | 52-50201 | 4/1977 |
| JP | 1-174590 | 12/1989 |
| JP | 10-227291 | 8/1998 |
| JP | 2002-89478 | 3/2002 |

OTHER PUBLICATIONS

English language Abstract of JP 2002-89478, Mar. 27, 2002.
English language Abstract of JP 10-227291.

* cited by examiner

*Primary Examiner*—Ninh H Nguyen
(74) *Attorney, Agent, or Firm*—Greenblum & Bernstein P.L.C.

(57) ABSTRACT

To provide a pump comprising an impeller which sucks and discharges liquid, a motor unit which drives the impeller, a parting plate which is disposed between the impeller and the motor unit and which partitions the impeller and the motor unit, a case formed with a pump chamber in which the impeller is accommodated, a suction port which is connected to the case and which sucks liquid and a discharge port which discharges liquid, wherein the case is provided with a discharge passage which discharges liquid introduced into the pump chamber from the suction port, the discharge passage has a predetermined diameter, the discharge passage is provided along an outer periphery of the pump chamber at a location at a predetermined distance from the outer periphery of the pump chamber, the pump further comprises at least one reflow passage which brings the discharge passage and the pump chamber into communication with each other and through which liquid flowing through the discharge passage flows back to the pump chamber.

6 Claims, 3 Drawing Sheets

PUMP AND LIQUID SUPPLY APPARATUS HAVING THE PUMP

CROSS REFERENCE TO RELATED APPLICATIONS

This application is based upon and claims the benefit of priority from prior Japanese Patent Application P2005-244914 filed on Aug. 25, 2005; the entire contents of which are incorporated by reference herein.

BACKGROUND OF THE INVENTION

The present invention relates to a pump which is driven by a motor and which sucks and discharges liquid, and to a liquid supply apparatus having the pump.

The pump includes an impeller which sucks and discharges liquid, a motor unit which drives the impeller, and a parting plate which is disposed between the impeller and the motor unit and has a function for parting therebetween. The pump also includes a case in which a pump chamber is formed. The impeller is accommodated in the pump chamber. The pump also includes a suction port which is connected to the case and through which liquid is sucked, and a discharge port through which liquid is discharged.

The case is provided with a discharge passage through which liquid including gas is discharged into the discharge port from the pump chamber.

As disclosed in Japanese Patent Application Laid-open No. H10-227291 (Patent Document 1), in the pump having the above-described structure, liquid including gas such as air is introduced into the pump chamber from the suction port by the rotating impeller. The liquid is sent to the discharge passage, and gas and liquid are separated in the discharge passage. As a result, gas separated above the liquid by a specific gravity difference and a portion of liquid are discharged from the discharge port.

If this pump is used, the pump can include a so-called self-support function capable of maintaining a supply function of liquid by separating gas from the liquid including the gas which flows into the pump chamber and by discharging the gas.

SUMMARY OF THE INVENTION

If the above conventional structure is used for a pump used for a liquid cooling type cooling apparatus which supplies liquid as refrigerant to an electronic part such as a CPU to cool the same, however, the mounting directions of the pumps are not always constant, and the pumps are used in various mounting direction in many cases due to convenience of structure of an internal device or design of an apparatus.

Therefore, the pump described in Patent Document 1 has a problem that gas and liquid cannot sufficiently be separated from each other depending upon the mounting direction, the self-support function is deteriorated and as a result, liquid cannot reliably be supplied.

The present invention has been achieved to solve such a conventional problem, and it is an object of the invention to provide a pump capable of maintaining a self-support function and always reliably supplying liquid without being limited by the mounting direction, and to provide a liquid supply apparatus having the pump.

To achieve the above object, the present invention provides a pump including an impeller which sucks and discharges liquid, a motor unit which drives the impeller, a parting plate which is disposed between the impeller and the motor unit and which partitions the impeller and the motor unit, a case formed with a pump chamber in which the impeller is accommodated, a suction port which is connected to the case and which sucks liquid and a discharge port which discharges liquid, wherein the case is provided with a discharge passage which discharges liquid introduced into the pump chamber from the suction port, the discharge passage has a predetermined diameter, the discharge passage is provided along an outer periphery of the pump chamber at a location at a predetermined distance from the outer periphery of the pump chamber, the pump further includes at least one reflow passage which brings the discharge passage and the pump chamber into communication with each other and through which liquid flowing through the discharge passage flows back to the pump chamber.

According to the present invention, even if gas stays in the pump chamber and liquid cannot be discharged, liquid in the discharge passage flows into the pump chamber through the reflow passage, the liquid rotates the impeller and a portion of the gas in the pump chamber is discharged into the discharge passage. Therefore, the self-support function can be maintained irrespective of the mounting direction of the pump. With this configuration, the present invention can provide a pump capable of always reliably supplying liquid.

According to the present invention, since the discharge passage is formed on the side of side surface of the pump chamber, the thickness of the pump can be reduced, and the pump can be disposed also in a narrow space.

In the present invention, since the discharge passage is provided in an upper portion of the pump chamber, the length of the pump as viewed from above can be shortened, and the pump can be disposed also in a narrow space.

In the present invention, the pump of the invention having the above effects is assembled in a liquid supply apparatus such as a cooling apparatus of an electronic part, the operability of the liquid supply apparatus can remarkably be enhanced.

DETAILED DESCRIPTION OF THE PREFERRED EMBODIMENTS

Exemplary embodiments to which the present invention is applied will be explained below in detail with reference to the drawings.

First Embodiment

Figure 1:
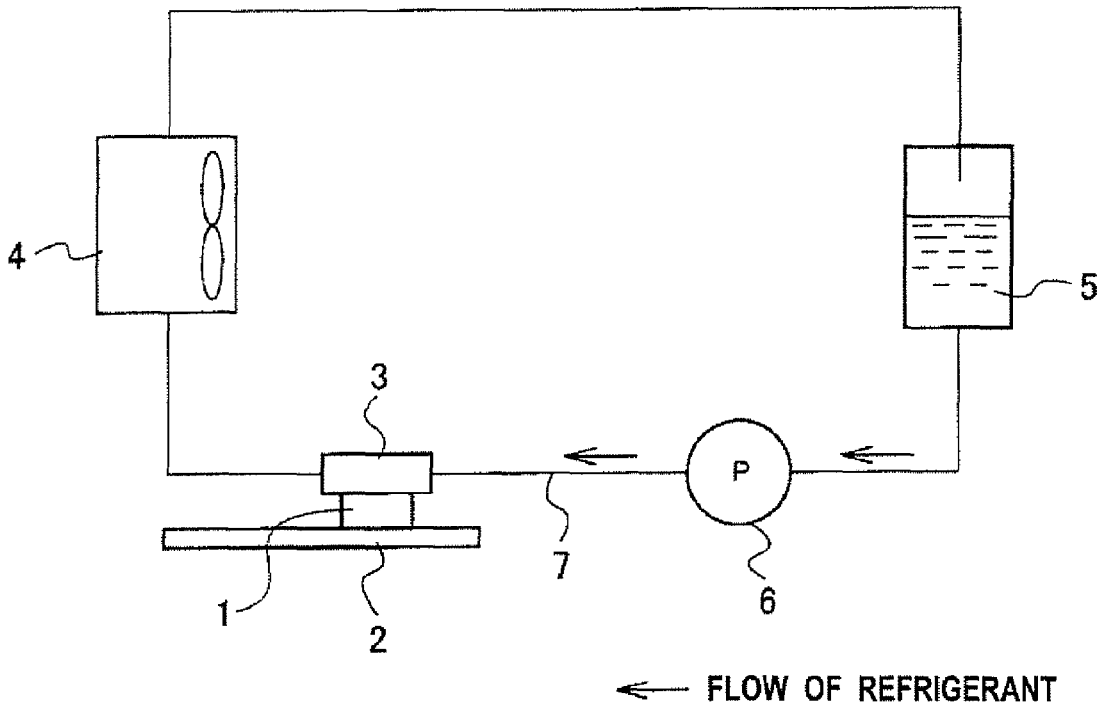
FIG. 1 is a general schematic view of a cooling apparatus of an electronic part according to first and second embodiments of the present invention.

As shown in FIG. 1, a liquid supply apparatus has a heat-generating part 1 mounted on a base plate 2. The liquid supply apparatus includes a cooling device 3 which heat exchanges between the heat-generating part 1 and a refrigerant to cool the heat-generating part 1.

The liquid supply apparatus also includes a radiator 4 which removes heat from the refrigerant, a reserve tank 5 which reserves the refrigerant therein, a pump 6 which circulates the refrigerant, and a pipe 7 which connects the cooling device 3, the radiator 4, the reserve tank 5 and the pump 6 to one another.

The refrigerant in the reserve tank 5 is discharged from the pump 6 and then, the refrigerant is sent to the cooling device 3 through the pipe 7, absorbs heat of the heat-generating part 1 and with this, the temperature of the refrigerant is increased, the heated refrigerant is sent to the radiator 4.

The refrigerant is cooled by the radiator 4, the temperature of the refrigerant is lowered and the refrigerant is returned to the reserve tank 5.

In this manner, the refrigerant is supplied to the radiator 4 by the pump 6 and is circulated, thereby cooling the heat-generating part 1.

Figure 2:
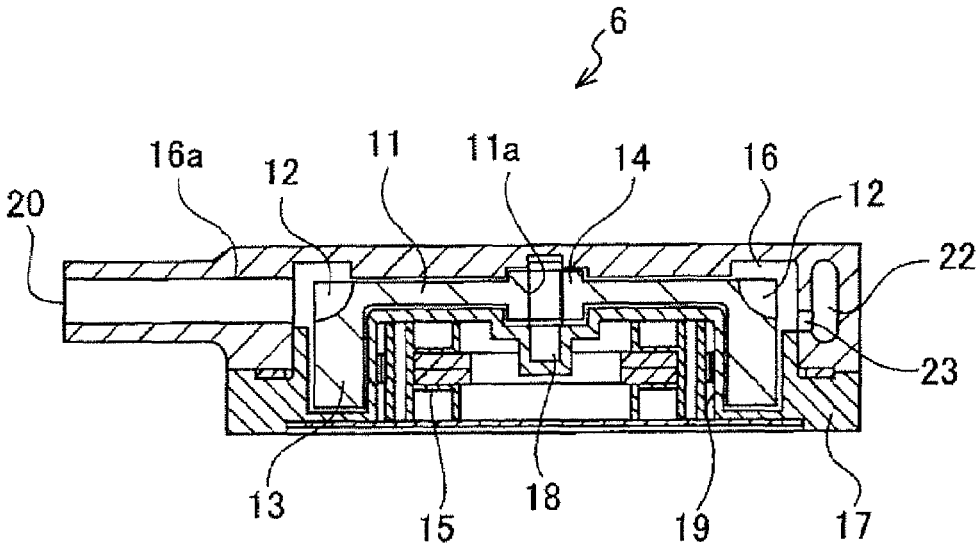
FIG. 2 is a vertical sectional view of a pump according to the first embodiment.
Figure 3:
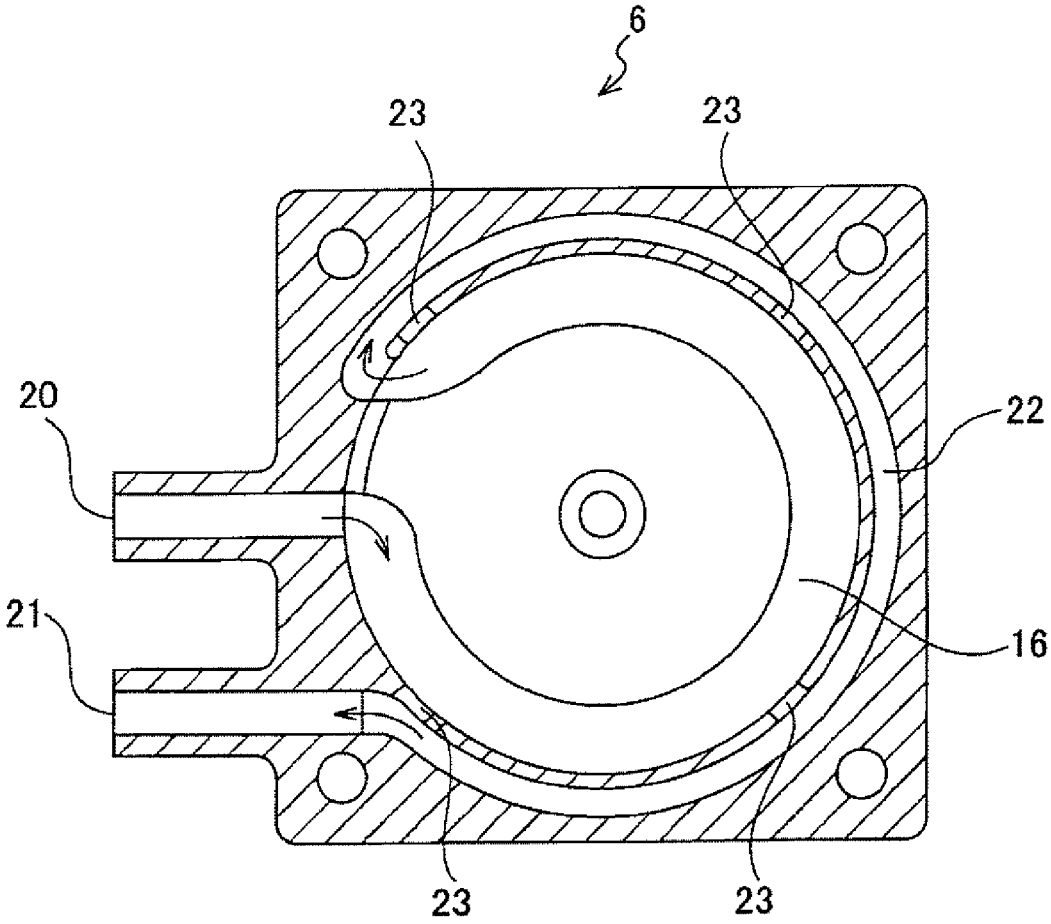
FIG. 3 is a transverse sectional view of a discharge passage of the pump according to the first embodiment.

FIGS. 2 and 3 are sectional views of a small pump of a first embodiment of the present invention.

As shown in FIG. 2, the pump includes an impeller 11 which sucks and discharges liquid, and a large number of blades 12 are formed on an upper side of an outer periphery of the impeller 11.

A rotor magnet 13 is mounted on an inner peripheral side of the impeller 11. A bearing 14 is disposed on a center portion of the impeller 11. The rotor magnet 13 is provided at its inner peripheral side with a motor stator 15 constituting the motor unit.

Next, a pump casing 16*a* of the pump 6 forms a pump chamber 16 therein. The impeller 11 is accommodated in the pump chamber 16. The pump chamber 16 introduces fluid, which kinetic energy is given by the impeller 11, to a discharge port 21.

As shown in FIG. 2, a parting plate 17 is disposed on a lower side of the pump casing 16*a*. The parting plate 17 air-tightly divides the pump chamber 16 and the motor stator 15. Between the rotor magnet 13 and the motor stator 15, a dividing wall 19, which is a portion of the parting plate 17, is integrally formed with the parting plate 17.

A shaft 18 is fixed to the pump casing 16*a*. The shaft 18 is inserted into a through opening 11*a* formed at a center of the impeller 11. The impeller 11 can slide on the shaft 18.

A suction port 20 through which liquid flows, and a discharge port 21 from which liquid is discharged are connected to the pump casing 16*a*.

In the pump casing 16*a*, a discharge passage 22 which discharges, into the discharge port 21, liquid flowing into the pump chamber 16 is set along a side surface of an outer periphery of the pump chamber 16. The discharge passage 22 is formed at its predetermined four locations with reflow passages 23 which bring the pump chamber 16 and the discharge passage 22 into communication with each other. The reflow passages 23 are provided at two locations close to an inlet of the discharge passage 22 and at two locations close to an outlet of the discharge passage 22.

With regard to the above structure, an operation of the pump of the first embodiment will be explained with reference to FIGS. 2 and 3.

When electricity is supplied from an external power supply, current controlled by an electric circuit (not shown) provided in the pump 6 flows through a coil of the motor stator 15, and this generates a rotating magnetic field.

If the rotating magnetic field is applied to the rotor magnet 13, a physical force is generated in the rotor magnet 13.

Here, since the rotor magnet 13 and the impeller 11 are integrally formed together, the rotation torque is applied to the impeller 11, and the impeller 11 starts rotating around the shaft 18 by this rotation torque.

If the impeller 11 starts rotating, the blades 12 provided on the upper side of the outer periphery of the impeller 11 give the kinetic energy to fluid which flows in from the suction port 20, the pressure of the fluid in the pump casing 16*a* is gradually increased by this kinetic energy, and the fluid is discharged out from the discharge port 21 through the discharge passage 22.

If the fluid mixed with gas flows in from the suction port 20, since the gas can be compressed, the impeller 11 cannot push the gas out from the pump chamber 16, only liquid is discharged out from the discharge passage 22 formed in the side surface of the pump chamber 16 and as a result, gas stays in the pump chamber 16 and liquid cannot be sent out.

If the pump is brought into such a state, liquid in the discharge passage 22 flows into the pump chamber 16 through the reflow passage 23, and a portion of gas in the pump chamber 16 is discharged into the discharge passage 22 by the liquid supplied to the impeller 11.

This action is repeatedly carried out to discharge all gas in the pump chamber 16 and thereafter, liquid can be discharged into the discharge passage 22 from the pump chamber 16.

The discharge passage 22 is formed in the side surface of the outer periphery of the pump chamber 16, and the reflow passage 23 which brings the discharge passage 22 and the pump chamber 16 into communication with each other is provided at the predetermined position. With this configuration, even if the pump 6 is mounted such that the discharge port 21 is oriented in a direction other than the upward direction, the liquid in the discharge passage 22 reflows into the pump chamber 16 through the reflow passage 23, all gas in the pump chamber 16 is discharged into the discharge passage 22 as described above and then, fluid can be discharged from the discharge port 21 and as a result, liquid can be discharged from the pump chamber 16.

According to the first embodiment, as described above, it is possible to discharge gas in the pump chamber 16 and reliably supply liquid, i.e., it is possible to always maintain the self-support function irrespective of the mounting direction of the pump. Since the discharge passage 22 is formed on the side of the side surface of the outer periphery of the pump chamber 16, the thickness of the pump can be reduced. Thus, it is possible to provide a small pump capable of always reliably supplying liquid without limiting the mounting place.

Second Embodiment

In a second embodiment of the present invention, the same structure and constituent elements having the same effects as those of the first embodiment are designated with like reference numerals, and detailed explanation thereof in the first embodiment will be used here.

The discharge passage 22 is formed in the side surface of the outer periphery of the pump chamber 16 in the first embodiment. In the second embodiment, however, the discharge passage 22 is provided substantially in parallel to the pump chamber 16 and at a position higher than the pump chamber 16.

Figure 4:
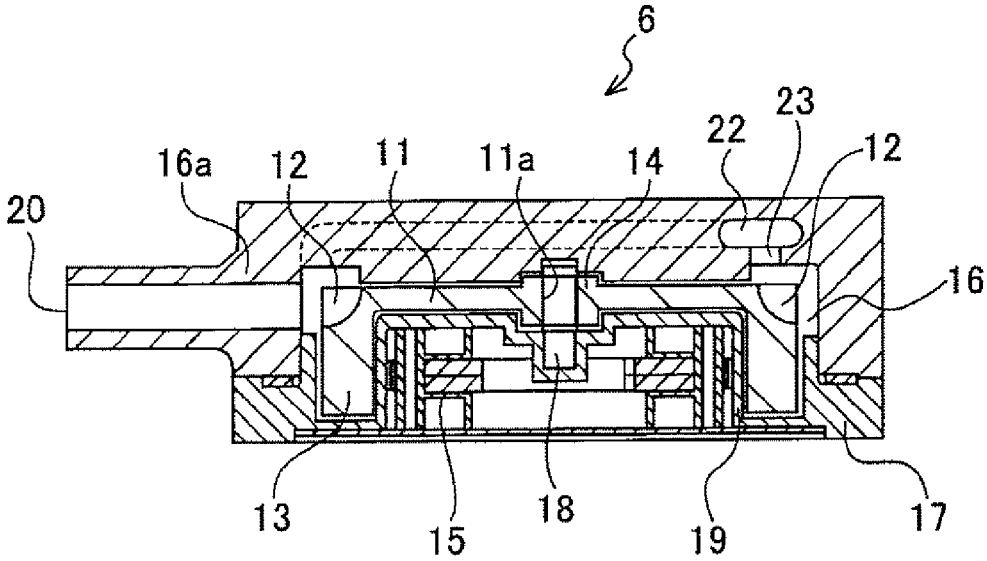
FIG. 4 is a vertical sectional view of a pump according to the second embodiment.
Figure 5:
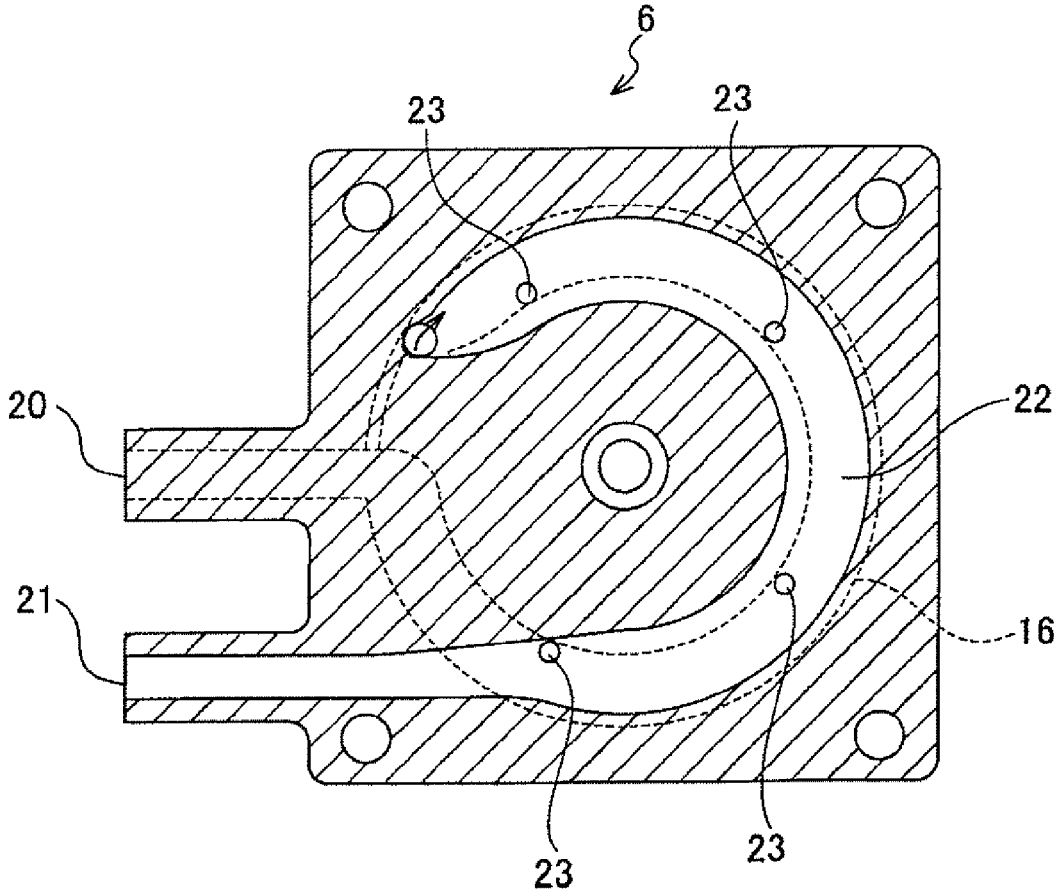
FIG. 5 is a transverse sectional view of a discharge passage of the pump according to the second embodiment.

Based on the difference, the action of the pump 6 in the second embodiment will be explained with reference to FIGS. 4 and 5.

In the pump 6 of the second embodiment, like the first embodiment, fluid which does not include gas, i.e., liquid flows in from the suction port 20, the pressure of the liquid is increased in the pump chamber 16, and the liquid is discharged from the discharge port 21 through the discharge passage 22.

Whereas in the second embodiment, if fluid in which gas is mixed flows into the pump, since the gas can be compressed, the impeller 11 does not push out the gas from the pump chamber 16, and the impeller 11 pushes out only liquid toward the discharge passage 22 provided in the upper portion of the pump chamber 16. Therefore, gas stays in the pump chamber 16 and liquid cannot be sent out.

If the pump is brought into such a state, liquid in the discharge passage 22 flows into the pump chamber 16 from downwardly through the reflow passage 23, and a portion of gas in the pump chamber 16 is discharged into the discharge passage 22 disposed in the upper portion of the pump chamber 16.

This action is repeatedly carried out to discharge all gas in the pump chamber 16 and thereafter, only liquid can be discharged into the discharge passage 22 from the pump chamber 16.

The discharge passage 22 is formed substantially in parallel to and above the pump chamber 16, and the reflow passage 23 which brings the discharge passage 22 and the pump chamber 16 into communication with each other is provided at the predetermined position. With this configuration, even if the pump 6 is mounted such that the discharge port 21 is oriented in a direction other than the upward direction, the liquid in the discharge passage 22 reflows into the pump chamber 16 through the reflow passage 23, all gas in the pump chamber 16 is discharged into the discharge passage 22 as described above and then, fluid can be discharged from the discharge port 21 and as a result, liquid can be discharged from the pump chamber 16.

According to the second embodiment as described above, it is possible to discharge gas in the pump chamber 16 and reliably supply liquid, i.e., it is possible to always maintain a so-called self-support function irrespective of the mounting direction of the pump. Since the discharge passage 22 is formed in the upper outer periphery of the pump chamber 16 and substantially in parallel to the pump chamber 16, the length of the pump 6 as viewed from above can be shortened. Thus, it is possible to provide a small pump capable of always reliably supplying liquid without limiting the mounting place.

Other Embodiments

Although the system which cools the heat-generating part is shown as one example of the liquid supply apparatus in the above embodiments, the liquid supply apparatus can be a fuel cell system which transfers liquid such as methanol, for example.

The blade 12 and the rotor magnet 13 can be made of different materials and fitted to each other and the impeller 11 can be formed integrally. Alternatively, the impeller 11 can be made of magnetic resin, the blade 12 and the rotor magnet 13 can be integrally formed using the same material.

The shaft 18 can be formed as an independent part and can be fixed to the pump casing 16*a* or the parting plate 17 by press fitting or insert forming, or the shaft 18 can be integrally formed of the same material as that of the pump casing 16*a* or the parting plate 17.

While the reflow passages 23 formed in the discharge passage 22 according to the first and the second embodiments are provided at four locations, the number of locations may be one, two, three, or more than five.

Although the pump casing 16*a* includes a single member in the first and the second embodiments, the pump casing 16*a* can be divided into a plurality of members and they can be assembled.

The liquid supply apparatus of the present invention can be expected to be applied to various liquid supply apparatuses used for, for example, a fuel cell apparatus and a heat pump apparatus.

While the embodiments of the present invention have been described above, the invention is not limited to the above embodiments and changes and modifications can be made within the scope of the gist of the present invention.

What is claimed is:

1. A pump comprising an impeller which draws and discharges liquid, a motor which drives the impeller, a parting plate which is disposed between the impeller and the motor and which partitions the impeller and the motor, a case formed with a pump chamber in which the impeller is accommodated, a suction port which is connected to the case and which draws liquid and a discharge port which discharges liquid, wherein the liquid drawn through the suction port flows into the pump chamber from a radial direction of the impeller, the case is provided with a discharge passage which discharges liquid introduced into the pump chamber from the suction port, the discharge passage has a substantially circular shape and a predetermined diameter, the discharge passage is provided along an outer periphery of the pump chamber at a location at a predetermined distance from the outer periphery of the pump chamber, the pump further comprises at least one reflow passage formed in the discharge passage between the discharge passage and the pump chamber and which brings the discharge passage and the pump chamber into communication with each other and through which liquid flowing through the discharge passage flows back to the pump chamber.

2. The pump according to claim 1, wherein the discharge passage is provided on a side of the pump chamber.

3. The pump according to claim 1, wherein the discharge passage is formed in an upper portion of the pump chamber.

4. A liquid supply apparatus having the pump according to claim 1.

5. The pump according to claim 1, wherein the at least one reflow passage comprises a plurality of reflow passages.

6. The pump according to claim 1, wherein the at least one reflow passage comprises four reflow passages including two reflow passages positioned adjacent close to an inlet of the discharge passage, and two reflow passages positioned adjacent close to an outlet of the discharge passage.

* * * * *